US006431514B1

(12) United States Patent
Ailing

(10) Patent No.: US 6,431,514 B1
(45) Date of Patent: Aug. 13, 2002

(54) SUPPORT RING FOR TOOL

(76) Inventor: George B. Ailing, 10777 Julie St., Alliance, OH (US) 44601-8301

( * ) Notice: Subject to any disclaimer, the term of this patent is extended or adjusted under 35 U.S.C. 154(b) by 0 days.

(21) Appl. No.: 09/521,173

(22) Filed: Mar. 8, 2000

Related U.S. Application Data

(60) Provisional application No. 60/123,964, filed on Mar. 12, 1999.

(51) Int. Cl.[7] ..... A47F 5/00; A47F 7/00

(52) U.S. Cl. ..... 248/315; 248/583

(58) Field of Search ..... 248/315, 317, 248/313, 141, 291.1, 102, 103, 105, 106, 58, 62, 583; 211/69, 66, 69.5, 70.6

(56) References Cited

U.S. PATENT DOCUMENTS

| | | | | | |
|---|---|---|---|---|---|
| 1,488,120 | A | | 3/1924 | Hubbard | |
| 2,183,332 | A | * | 12/1939 | Haritos | 248/313 |
| 2,557,728 | A | * | 6/1951 | Drumb | 248/315 |
| 2,989,278 | A | * | 6/1961 | Hyman | 248/583 |
| 3,333,800 | A | | 8/1967 | Steiner | 248/17 |
| 3,417,949 | A | | 12/1968 | Waber | 248/13 |
| 3,629,978 | A | | 12/1971 | Coes, Jr. | 51/126 |
| 3,851,979 | A | * | 12/1974 | Becker | 248/62 |
| 4,033,532 | A | | 7/1977 | Bergquist et al. | 248/17 |
| 4,166,602 | A | | 9/1979 | Nilsen et al. | 248/280.1 |
| 5,129,610 | A | * | 7/1992 | Campbell | 248/106 |
| 6,113,039 | A | * | 9/2000 | Riffle | 248/62 |

* cited by examiner

*Primary Examiner*—Leslie A. Braun
*Assistant Examiner*—Gwendolyn Baxter
(74) *Attorney, Agent, or Firm*—Sand & Sebolt

(57) ABSTRACT

The support ring of the includes an outer mounting bracket that is connected to a fixed bracket by a swivel. The outer mounting bracket pivotly supports a bolt-together collar that rotatably receives an inner collar. The inner collar is designed to tightly clamp onto the tool to be supported. The inner collar and the tool thus rotate inside the outer collar while the outer collar allows the tool to pivot with respect to the bracket. The support ring thus allows the tool to be weightlessly supported in essentially any useful position as if the tool were not supported at all.

18 Claims, 7 Drawing Sheets

SUPPORT RING FOR TOOL

CROSS REFERENCE TO RELATED APPLICATION

This application claims priority from U.S. Provisional Patent Application Ser. No. 60/123,964 filed Mar. 12,1999, the disclosures of which are incorporated herein by reference.

TECHNICAL FIELD

This invention generally relates to tools and, more particularly, to a support ring that holds a tool that allows the tool to be used in a variety of positions. Specifically, the present invention relates to a support ring for an impact hammer that has an inner clamping ring that is rotatably carried by an outer ring which is, in turn, pivotly mounted to a U-shaped bracket that is, in turn, pivotly mounted to a support structure. The support ring of the present invention allows a heavy tool, such an impact hammer, to be weightlessly supported while allowing the user to move the tool into essentially any position as if the tool was not supported.

BACKGROUND INFORMATION

Various heavy power tools that must be used for long periods of time are known in the art. One such tool is an impact hammer that is used to break welds in the automotive industry. It is thus desired in the art to support the weight of these tools by a support mechanism so that the user does not have to hold the entire weight of the tool while working.

Different devices have been developed in the art for holding impact hammers. These devices generally support the weight of the impact hammer from above while allowing the device to move. These devices either work with air pressure or springs. The devices have not, however, provided enough movement of the tool with respect to a work piece. The users of the tools thus desire a support arrangement that allows the tool to be used in a wider variety of locations and angles when supported by these support devices.

SUMMARY OF THE INVENTION

In view of the foregoing, it is an objective of the present invention to provide a support ring for a tool that allows the tool to rotate or pivot about two axes in addition to a third axis on which the weight of the tool is supported.

Another objective of the present invention is to provide a support ring for a tool that clamps onto the tool to form a tight connection between the support ring and the tool.

Another objective of the present invention is to provide a support ring for a tool that allows the tool to rotate 360 degrees about its longitudinal axis as well as pivot about a horizontal axis while being rotationally supported from above about a vertical axis.

These and other objectives of the present invention are achieved by the support ring for a tool as disclosed below and in the accompanying drawings.

BRIEF DESCRIPTION OF THE DRAWINGS

The preferred embodiments of the invention, illustrative of the best mode in which applicant contemplated applying the principles of the invention are set forth in the following description and are shown in the drawings and are particularly and distinctly pointed out and set forth in the appended claims.

Similar numbers refer to similar elements throughout the specification.

DESCRIPTION OF THE PREFERRED EMBODIMENTS

Figure 1:
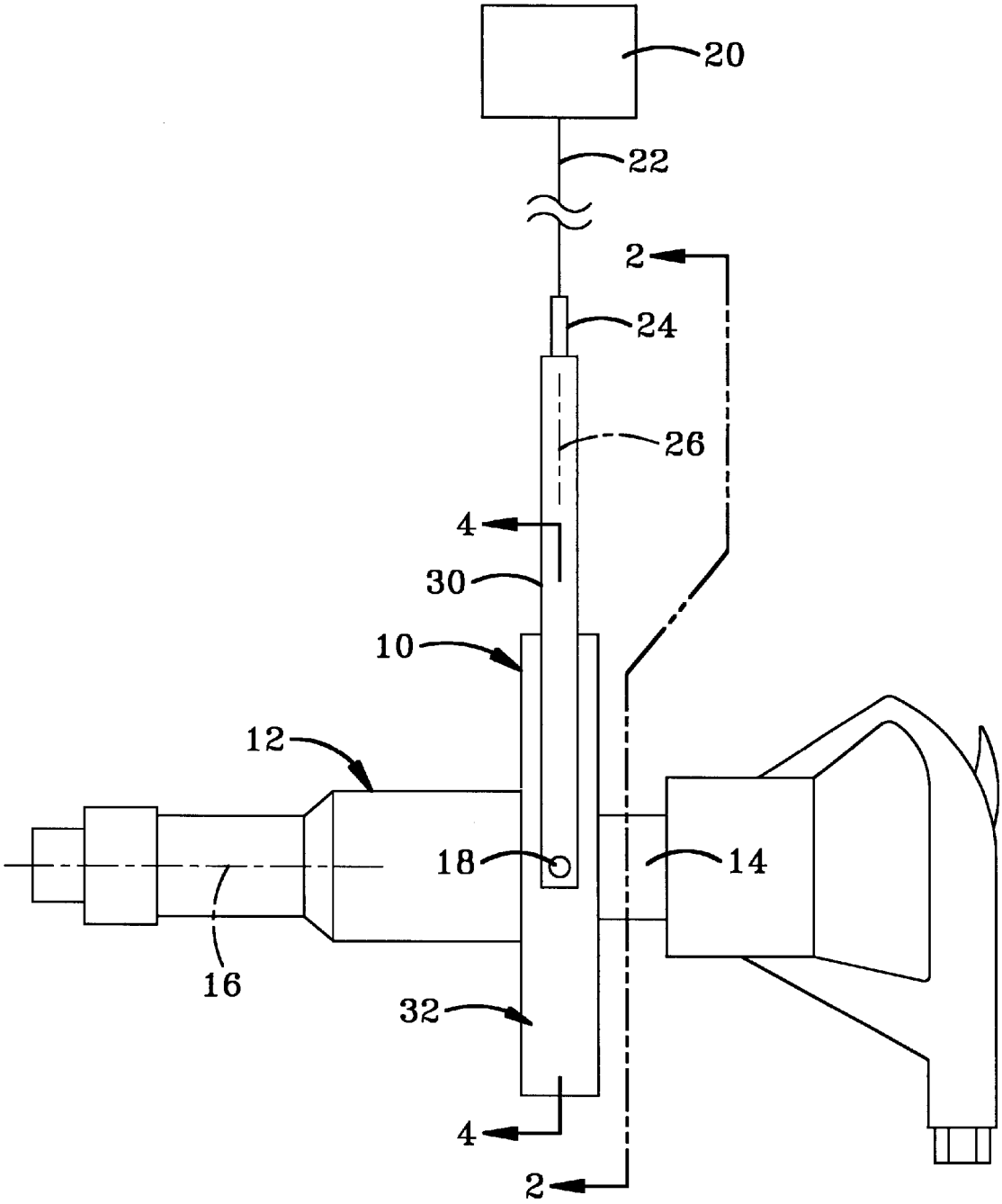
FIG. 1 is a side elevational view of the support ring of the present invention used hold a tool.
Figure 2:
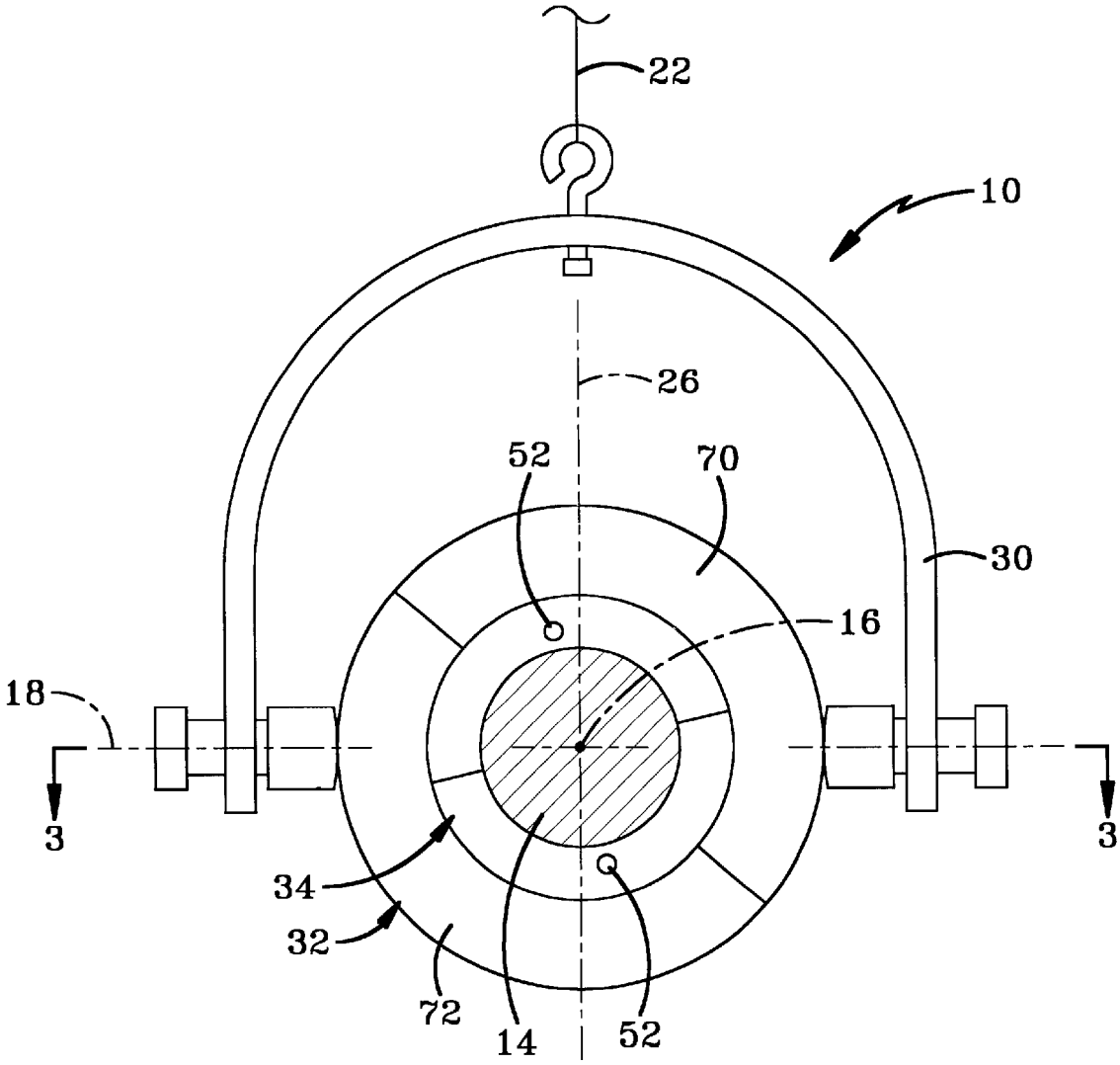
FIG. 2 is a sectional view taken along line 2—2 of FIG. 1.
Figure 3:
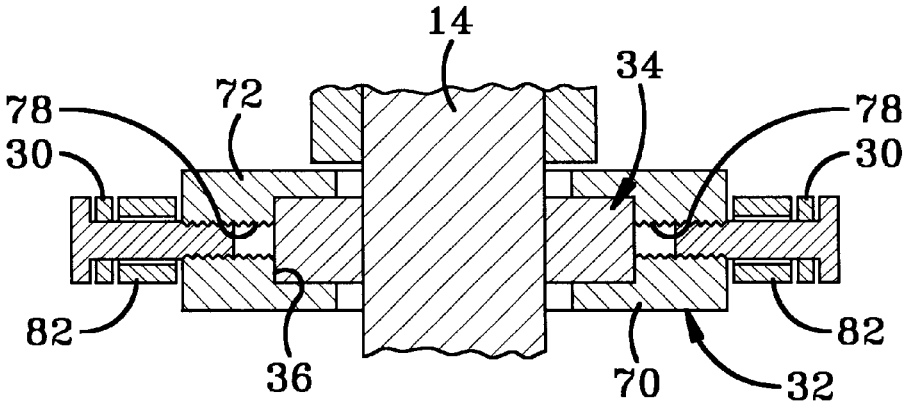
FIG. 3 is a sectional view taken along line 3—3 of FIG. 2.

The support ring of the present invention is indicated generally by the numeral 10 in the accompanying drawings. Support ring 10 is depicted in the drawings as carrying a tool 12 having at least one area 14 having a substantially cylindrical outer surface. Support ring 10 is configured to clamp around area 14 of tool 12 to form a secure connection between ring 10 and tool 12. In operation, support ring 10 allows tools 12 to freely rotate about the longitudinal axis 16 of tool 12 as well as pivot about a pivot axis 18 that is substantially perpendicular to longitudinal axis 16. The mounting device 20 that supports the weight of tool 12 typically includes a cable 22 that mounts to a swivel 24 that allows tool 12 to rotate about the vertical axis 26 while in use.

Support ring 10 generally includes an outer mounting bracket 30, an outer bolt-together collar 32, and an inner bolt-together collar 34. Inner collar 34 is sized and configured to clamp against area 14 of tool 12 such that there is relatively no movement between collar 14 and tool 12 when tool is in operation. Collar 34 is slidingly seated in a U-shaped channel 36 formed in outer collar 32 such that inner collar 34 may rotate freely with respect to outer collar 32 but may not move longitudinally with respect to outer collar 32. In the preferred embodiment of the present invention, inner collar 34 is fabricated from brass and outer collar 32 is fabricated from steel such that there is smooth sliding engagement between the two elements. Lubrication may be used if desired.

Figure 4:
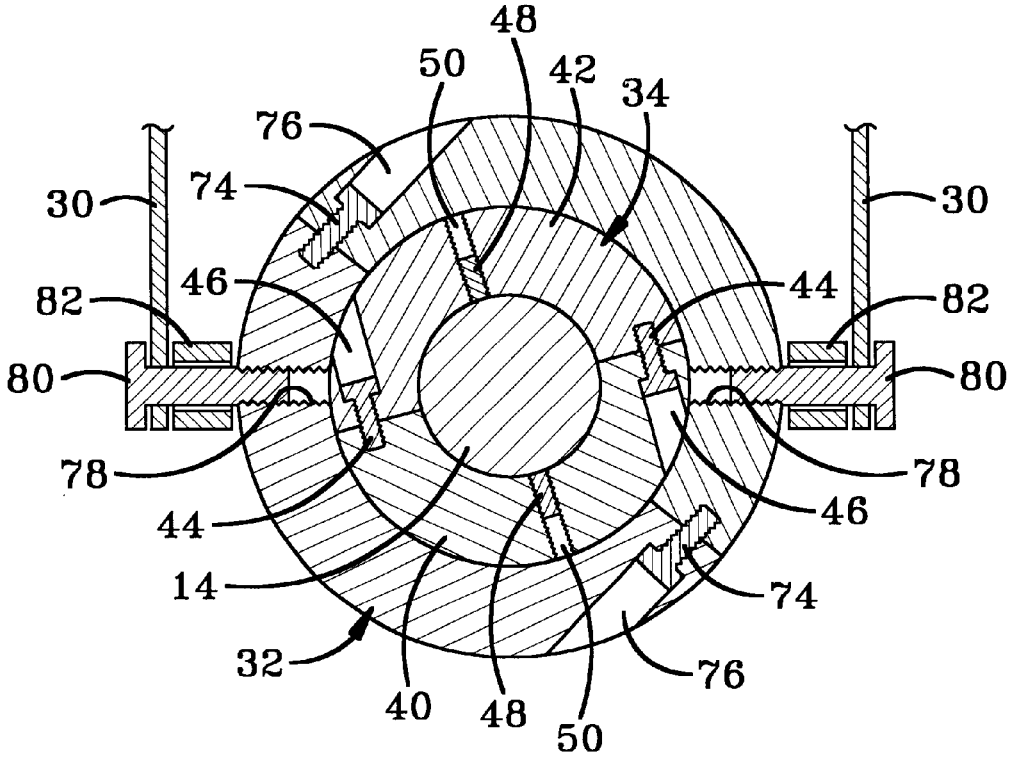
FIG. 4 is a sectional view taken along line 4—4 of FIG. 1.

As shown in FIG. 4, inner collar 34 is formed from two halves, 40 and 42 that bolt together with a pair of suitable bolts 44. Each bolt 44 is received in an appropriate bore 46 that is threaded to receive bolt 44.

Inner collar 34 further includes a pair of clamping screws 48 that are threadably received in threaded bores 50. Screws 48 are provided to ensure a secure fit between inner collar 34 and area 14 of tool 12. A pair of locking holes 52 may also be provided that communicate with bores 50 and screws 48. Locking members may be received in holes 52 to secure screws 48 in place. A tight secure connection between inner collar 34 and tool 12 is necessary given the vibrations created by tool 12.

Figure 5:
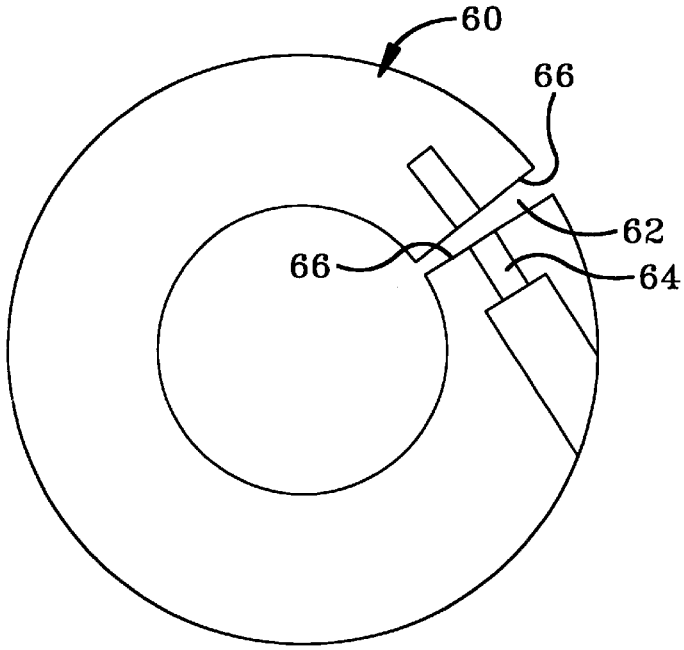
FIG. 5 is a sectional view of an alternative embodiment of the inner ring of the present invention.
Figure 6:
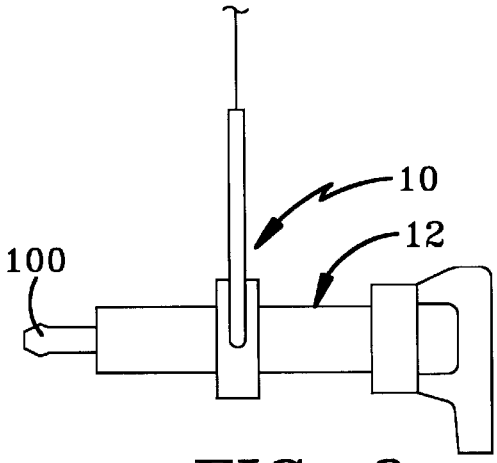
FIG. 6 is a side elevational view showing the support ring of the present invention used to holding tool in one position.

The inner diameter of inner collar 34 is preferably sized to be slightly smaller than the outside diameter of area 14. This configuration ensures that a tight clamping fit can be achieved between inner collar 34 and tool 12. In a second embodiment of the present invention, an inner collar 60 is used as shown in FIG. 5. Inner collar 60 includes a single piece with a slot 62. A bolt hole 64 extends through the body of inner collar 60 and is threaded to allow a suitable bolt to threadably engage bore 64. In operation, the bolt will pull the two edges 66 towards each other to allow inner collar 60 to clamp about tool 12. This configuration allows an extremely tight fit between inner collar 60 and tool 12 to be achieved by pulling the ends of inner collar 60 toward each other with the single bolt.

Outer bolt-together collar 32 includes a first half 70 and a second half 72 that are connected by a pair of suitable bolts 74 that are threadedly received in threaded boars 76. As described above, each half 70 and 72 is formed with a U-shaped channel 36 sized to snugly but slidably receive inner collar 34. A pair of bolt holes 78 are substantially oppositely disposed and pass entirely through a diameter of outer bolt-together collar 32. Bolt holes 78 provide access to bores or holes 50 so that the clamping connection between inner collar 34 and tool 12 may be adjusted without disassembling outer collar 32.

A pair of holding bolts 80 are threadedly received in holes 78. Spacers 82 slidingly engage bolts 80 and are used to space the ends of bracket 30 from outer collar 34 and to provide room inside bracket 30 through which tool 12 may pivot.

Support ring 10 is assembled by first clamping inner bolt-together collar 34 about area 14 of tool 12. Outer bolt-together 32 is then bolted together around inner collar 34. Locking screws 48 may then be tightened or retightened with access provided through holes 78. Spacers 82 and bolts 80 are then used to mount bracket 30 to outer collar 32. Bracket 30 is then connected to swivel 24 which is, in turn, connected to cable 22.

Figure 7:
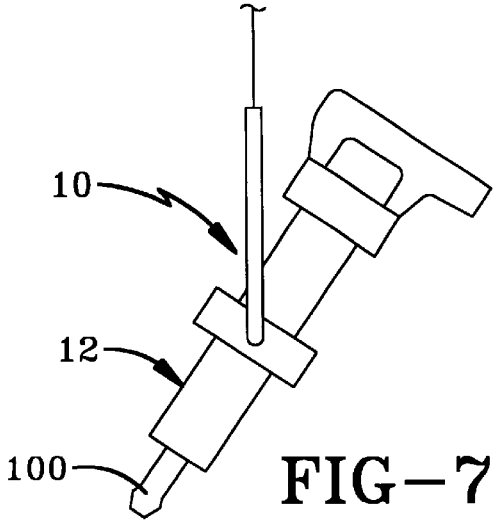
FIG. 7 is a side view similar to FIG. 6 showing the tool in the second position.
Figure 8:
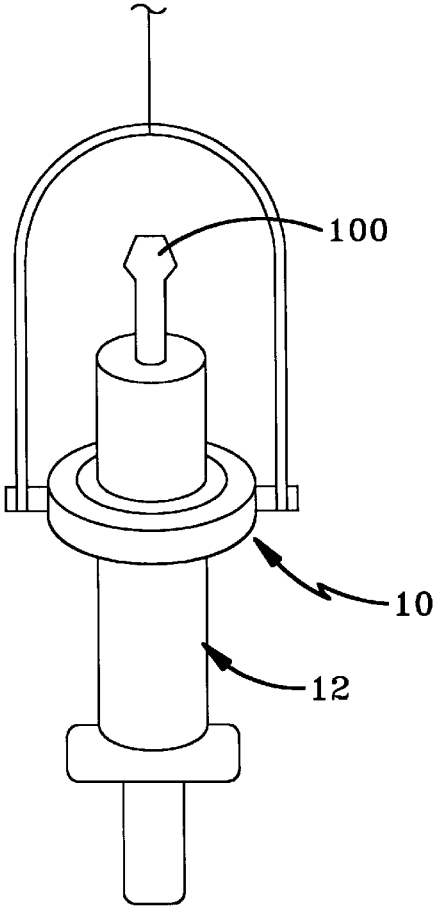
FIG. 8 is an end view showing the tool in a third position.
Figure 9:
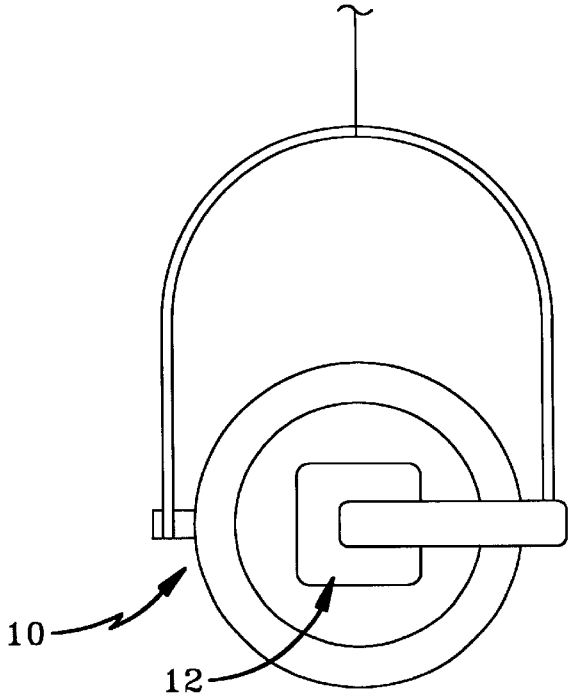
FIG. 9 is another end view showing the tool in a fourth position.
Figure 10:
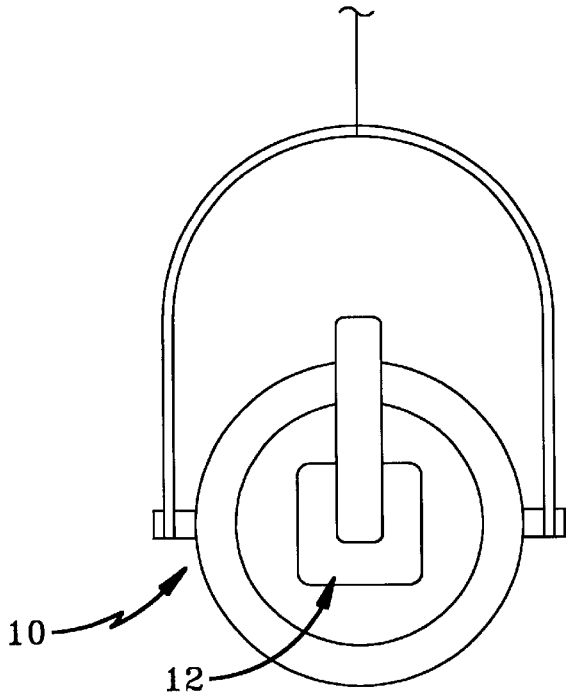
FIG. 10 is a view similar to view 9 showing the tool in the fifth position.
Figure 11A:
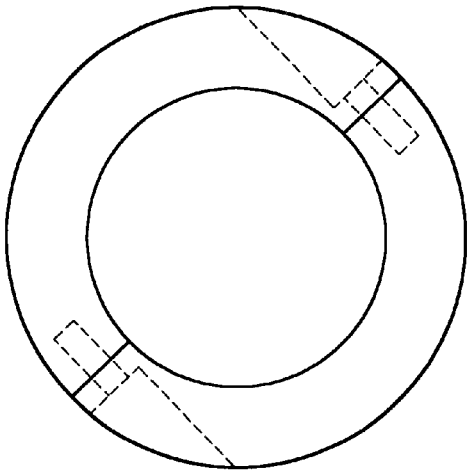
FIG. 11 is a manufacturing drawing for the brass bolt-together collar.
Figure 11B:
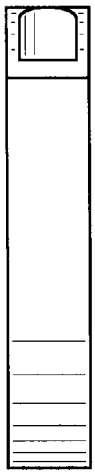
Figure 12A:
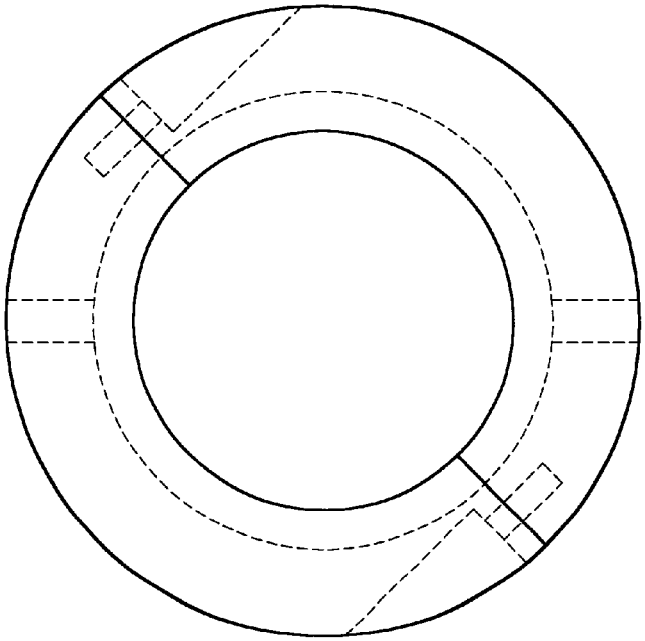
FIG. 12 is a manufacturing drawing for the steel bolt-together collar.
Figure 12B:
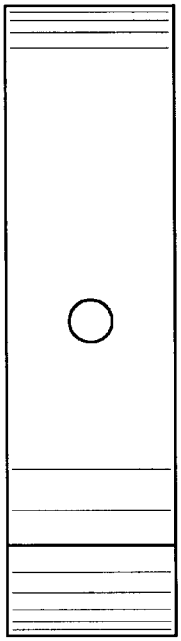
Figure 13A:
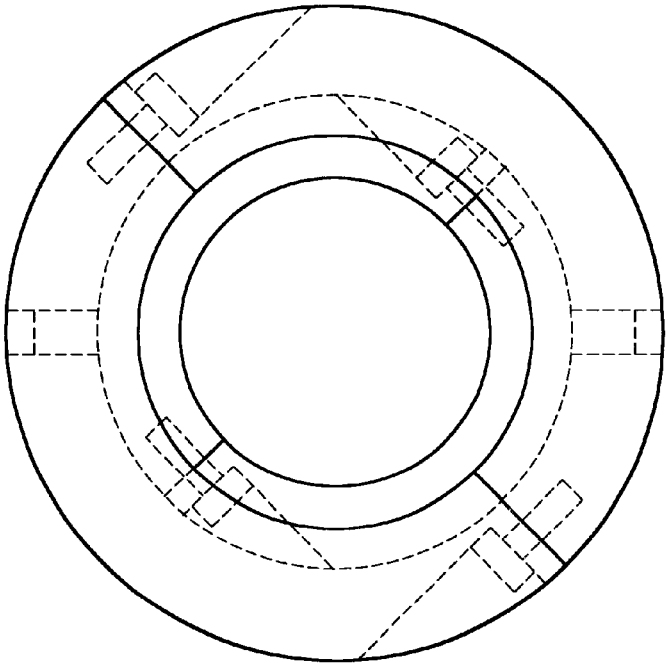
FIG. 13 is an assembly drawing of the brass and steel bolt-together collars.
Figure 13B:
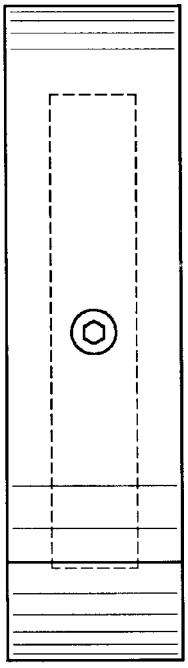

Tool 12 may be rotated to a variety of positions depicted in FIGS. 6–10 when it is held by support ring 10. Tool 12 may pivot up vertically as depicted in FIG. 7 or down vertically as depicted in FIG. 8. Bracket 30 provides space for tool 12 to move. Tool 12 may also be rotated 90 degrees as depicted in FIG. 9 or 180 degrees as depicted in FIG. 10. Tool 12 may be used in any or a combination of these positions as well as an infinite number of other positions while the tool is in use. Support ring 10 thus allows the user of the tool to position the working end 100 of the tool in a variety of desired positions without holding the entire weight of the tool. Support ring 10 thus allows the user to be more productive and risk fewer injuries while using tool 12.

Accordingly, the improved support ring for tool is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the support ring for tool is constructed and used, the characteristics of the construction, and the advantageous new and useful results obtained; the new and useful structures, devices, elements, arrangements, parts, and combinations are set forth in the appended claims.

I claim:

1. A support ring for a tool, the support ring comprising:
an outer mounting bracket;
an outer collar pivotally mounted to the outer mounting bracket;
the outer collar being disposed in a first plane;
an inner collar rotatably carried in an interior recess of the outer collar;
the outer collar defining a channel the inner collar being seated in the channel allowing the inner collar to rotate within the channel and preventing the inner collar from moving out of the first plane and from sliding with respect to the outer collar.

2. The support ring of claim 1, wherein the inner collar includes first and second halves connected together with connectors.

3. The support ring of claim 2, wherein each of the first and second halves are substantially half of a ring.

4. The support ring of claim 3, wherein the connectors are bolts.

5. The support ring of claim 1, wherein the inner collar includes an outer cylindrical surface and an inner cylindrical surface; at least one bore extending from the outer cylindrical surface to the inner cylindrical surface.

6. The support ring of claim 5, wherein at least a portion of the bore is threaded; a clamping screw received in the bore.

7. The support ring of claim 5, wherein, the inner ring includes a front wall and a rear wall; a locking hole extending from one of the front and rear walls to the bore.

8. The support ring of claim 1, wherein the outer collar includes first and second halves connected together with connectors.

9. The support ring of claim 1, further comprising a spacer disposed between the outer mounting bracket and the outer collar.

10. The support ring of claim 9, further comprising a holding bolt connecting the outer mounting bracket to the outer collar; the spacer mounted on the holding bolt.

11. The support ring of claim 1, further comprising a swivel connected to the outer mounting bracket.

12. The support ring of claim 1, wherein the inner collar has first and second edges and a bolt extending between edges; rotation of the bolt causing the edges to move toward each other.

13. In combination:
a tool;
a support ring connected to the tool;
the support ring allowing the tool to pivot about first, second and third axes;
the first, second and third axes being substantially perpendicular to one another;

the support ring including an inner collar snapped to the tool;

the support ring including an outer collar defining a channel;

the outer collar being disposed in a first reference plane;

the inner collar rotating within the channel of the outer collar and rotating within the first reference plane;

support means for supporting the weight of the tool and the support ring; the support means including a/cable connected to the support ring.

14. The combination of claim 13, wherein the support ring includes an outer mounting bracket pivotally connected to the outer support ring.

15. The combination of claim 14, wherein the support ring includes a swivel connected to the outer mounting bracket; the support means connected to the swivel.

16. The combination of claim 17, further comprising a spacer disposed between the outer collar and the outer mounting bracket.

17. The combination of claim 13, wherein the inner collar can rotate 360 degrees with respect to the outer collar.

18. The combination of claim 13, wherein the channel defined by the outer collar is inwardly facing.

* * * * *